US005219582A

United States Patent [19]

Anderson et al.

[11] Patent Number: 5,219,582

[45] Date of Patent: Jun. 15, 1993

[54] APPARATUS FOR QUENCHING MELT SPUN FILAMENTS

[75] Inventors: Harvey G. Anderson; James V. Hartzog, both of Kinston; Harold L. Manning, Jr., Bethel; James W. Tolliver, Kinston, all of N.C.

[73] Assignee: E. I. Du Pont de Nemours and Company, Wilmington, Del.

[21] Appl. No.: 845,334

[22] Filed: Mar. 2, 1992

Related U.S. Application Data

[63] Continuation-in-part of Ser. No. 804,146, Dec. 6, 1991.

[51] Int. Cl.[5] ..... B29C 47/88

[52] U.S. Cl. ..... 425/72.2; 264/237; 425/378.2; 425/464

[58] Field of Search ..... 264/210.8, 211.15, 210.7, 264/235.6, 237, 143, 148, 151; 425/72.2, 378.2, 464

[56] References Cited

U.S. PATENT DOCUMENTS

| | | | |
|---|---|---|---|
| 3,067,458 | 12/1962 | Dauchert | 264/211.15 |
| 3,447,202 | 6/1969 | Kato | 264/211.15 |
| 3,619,452 | 11/1971 | Harrison | 425/72.2 |
| 3,834,847 | 9/1974 | Fletcher | 425/72.2 |
| 4,529,368 | 7/1985 | Makansi | 425/72.2 |
| 4,641,018 | 12/1986 | Valteris et al. | 425/72.2 |
| 4,712,988 | 12/1987 | Broaddus | 425/72.2 |

FOREIGN PATENT DOCUMENTS

| | | | |
|---|---|---|---|
| 2930553 | 2/1981 | Fed. Rep. of Germany | 425/378.2 |
| 2273886 | 2/1976 | France | 264/237 |
| 52-15692 | 5/1977 | Japan | 264/237 |
| 61-174411 | 8/1986 | Japan | 264/211.15 |

*Primary Examiner*—Jay H. Woo
*Assistant Examiner*—Khanh P. Nguyen

[57] ABSTRACT

An apparatus for radially quenching melt spun filaments features a quenching chamber having a foraminous distribution cylinder between the filaments and the gas supply chamber with areas of porosity that increases, from a first low value at a location immediately below the spinneret, through a larger value at lower location, and then decreases toward the exit of the quench chamber.

3 Claims, 3 Drawing Sheets

APPARATUS FOR QUENCHING MELT SPUN FILAMENTS

CROSS REFERENCE TO RELATED APPLICATION

This application is a continuation-in-part of application Ser. No. 07/804,146 filed Dec. 6, 1991.

FIELD OF THE INVENTION

This invention relates to melt spinning synthetic filaments and more particularly it relates to apparatus for radially quenching such filaments.

BACKGROUND OF THE INVENTION

Dauchert, in U.S. Pat. No. 3,067,458, discloses an apparatus and process for melt spinning polymeric filaments and quenching the filaments by continuously directing a constant velocity current of cooling gas radially inward from all directions towards the filaments through a foraminous distribution cylinder surrounding the filaments and thence concurrently downward with the filaments. These radical quench systems provide "constant" amounts of radial flow through the distribution cylinder from its top (near the spinneret) to its bottom (at the exit from the quench chamber).

Broaddus et al, in U.S. Pat. No. 4,712,988, discloses an apparatus for radially quenching melt spun filaments with a similar foraminous distribution cylinder located in a quench chamber between the filaments and a gas supply chamber, but Broaddus provides areas of progressively decreasing porosity from a location immediately below the spinneret toward the exit from the quench chamber. Thus Broaddus' vertical gas distribution pattern through the foraminous distribution cylinder was defined by maximum gas flow immediately below the spinneret decreasing to a minimum gas flow at the exit from the quench chamber. This pattern is referred to herein as "gradient", and has achieved dramatic improvements in spinning performance at higher spinning productivities, as disclosed by Broaddus et al.

However, when it has been desired to spin filaments of lower denier per filament at high spinning densities as disclosed herein, neither the "constant" pattern of Dauchert nor the "gradient" pattern of Broaddus have given satisfactory results.

SUMMARY OF THE INVENTION

Accordingly, there is provided, in an apparatus for melt spinning polymer that includes a spinneret, means for passing molten polymer through the spinneret, a hollow cylindrical foraminous member positioned immediately below the spinneret and a plenum chamber supplied with a current of gas surrounding the foraminous member to form a quench chamber for the filaments to pass through to its exit, the improvement for changing the gas distribution pattern inwardly toward the filaments in the chamber to a profile defined by a low but significant gas flow in a first zone immediately below the spinneret, increasing through a larger gas flow in a second zone at a location below the first zone, and then decreasing to a lesser gas flow before the exit of the quench chamber, comprising forming said hollow foraminous member of porosity that increases from a first low porosity in said first zone immediately below the spinneret, through a larger porosity is at said second zone at a location below said first zone, and then decreases to a second low porosity at the exit of the quench chamber. This is conveniently obtained by forming the foraminous member from a perforated plate with holes of diameters and/or densities that increase from corresponding first low values through larger values at said lower location to second low values at the exit.

Thus, the profile of the amounts of air supplied as the filaments progress through the quench chamber shows an amount that progressively increases before decreasing.

DETAILED DESCRIPTION OF THE ILLUSTRATED EMBODIMENT

An important feature of the apparatus and process according to the invention is the need to provide gas flow immediately below the spinneret and to supply increasing amounts of gas as the freshly-extruded filaments start to accelerate. Thus, a low, but sufficient, amount of quenching gas should be supplied immediately below the spinneret. Then the amount of gas supplied should progressively first increase, as the filaments accelerate, through a maximum amount of quenching gas, and then decreases lower down the quench chamber. This may be accomplished by dividing the quenching system under the spinneret into three or more zones, and controlling the amounts of gas supplied in these zones, accordingly. The amounts of gas flow may be controlled conveniently by varying the sizes and/or densities of the perforations or holes in the quenching screen(s) that surround(s) the freshly-extruded filaments and through which the quenching gas passes before encountering the filaments. This is similar to the technique disclosed by Broaddus et al in U.S. Pat. No. 4,712,988, the disclosure of which is hereby incorporated by reference herein. But, according to the present invention, unlike the Broaddus apparatus, maximum gas flow should not be located in the zone immediately below the spinneret. Conveniently, a first zone, over a distance of at least 0.25 inches immediately below the spinneret should be provided with this low, but sufficient, amount of quenching gas, generally air. It is the upper portion of the quench chamber that seems to be most critical. Ideally, perhaps, each successive row of perforations in the radical quenching screen could be tailored to provide the variations. However, as shown hereinafter in the Examples, we have shown a significant improvement by using three or more zones with different amounts of perforations for air flow.

The process and apparatus are described with reference to the accompanying Drawings.

Figure 1:
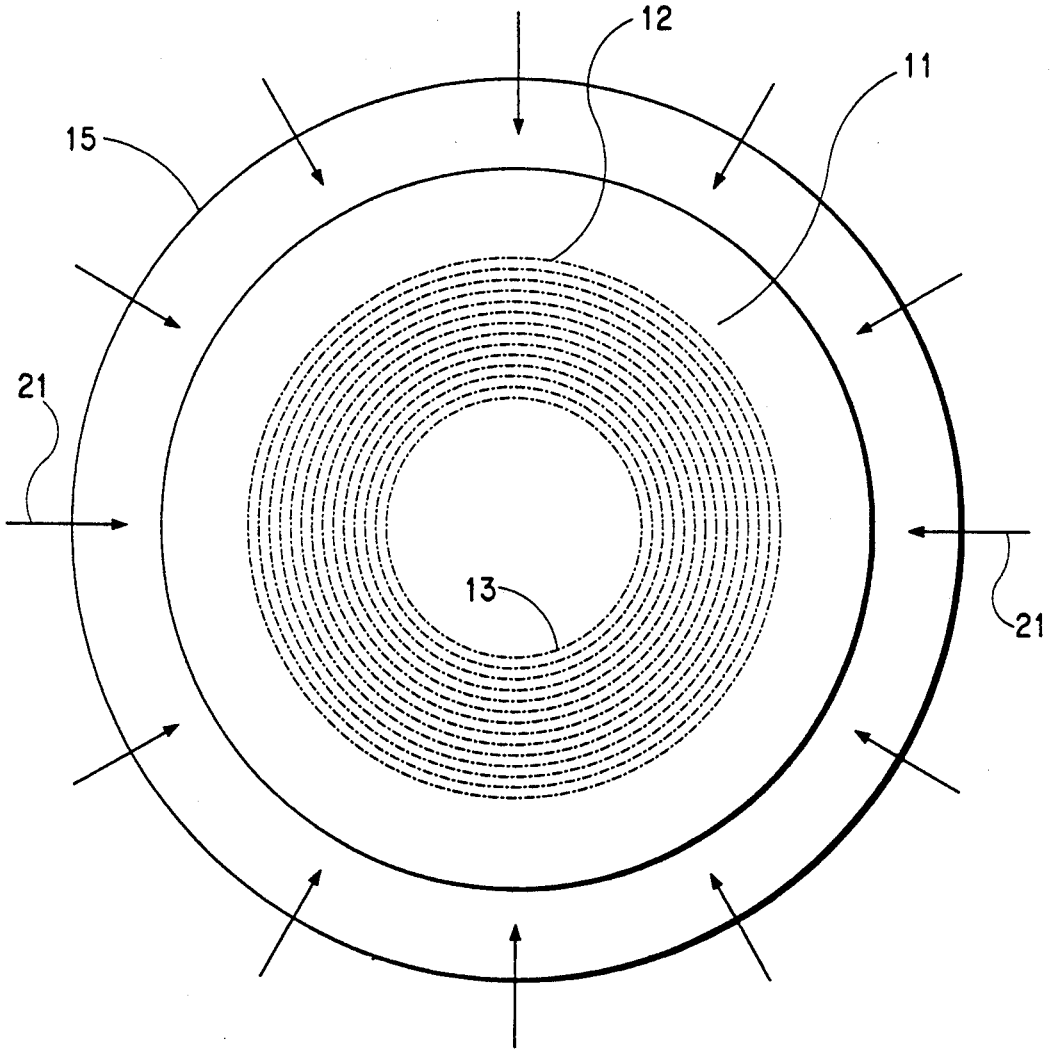
FIG. 1 is a schematic plan view of the quench distribution member and of the spinneret with a preferred capillary pattern.
Figure 2:
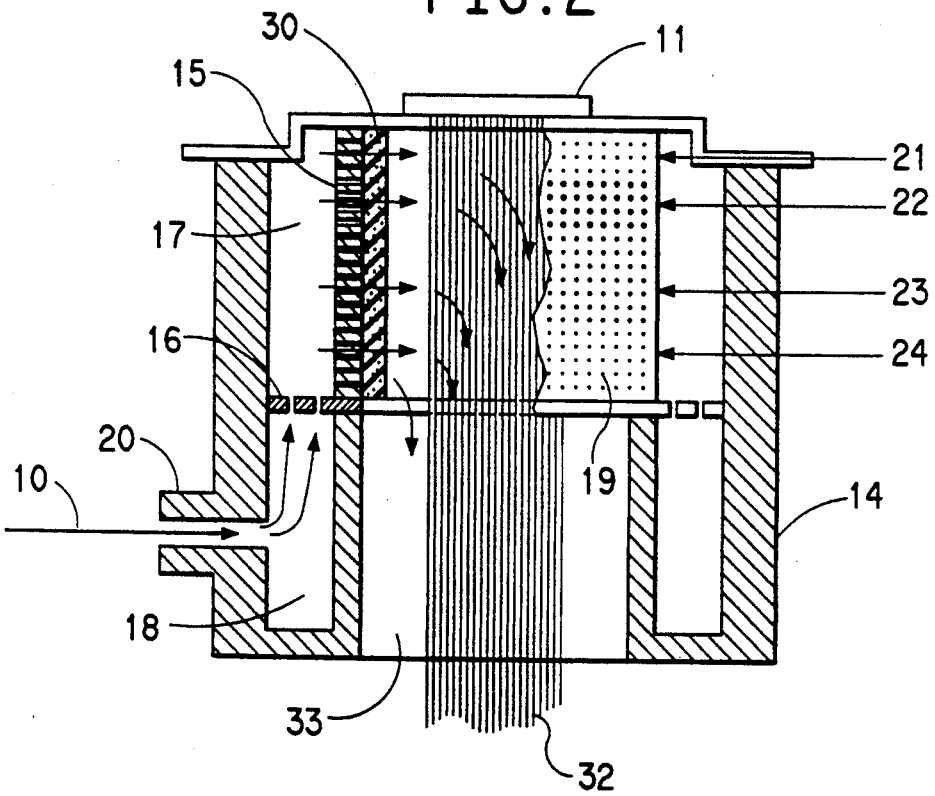
FIG. 2 is a sectional elevation view to show a preferred quench distribution chamber.

Referring now to FIGS. 1 and 2, the embodiment chosen for purposes of illustration includes a spinneret 11 through which a plurality of filaments 32 are extruded and then forwarded through a hollow cylindrical quenching chamber generally designated 14 to a guide (not shown) which comprises part of a conventional forwarding system. The hollow quenching chamber 14 is mounted immediately below the spinneret. The chamber 14 is provided with a lower annular chamber 18 having an inlet 20 for the introduction of cooling gas 10 and an upper annular chamber 17 for distributing cooling gas into internal chamber 33, in the vicinity of the filaments 32. The chambers 18, 17 are separated by a foraminous plate 16 that will distribute uniformly the gas entering into chamber 17. The inside wall 115 of chamber 17 is made of a cylindrical foraminous material, e.g., a cylindrical metal plate having holes 19 of varying diameters to provide areas of correspondingly different porosity as the filaments proceed from spinneret 10 toward the exit end of foraminous cylindrical plate 15, and of a foam covering 30 to diffuse the air flow In operation, gas 10 enters chamber 18 through inlet 20, then passes through distribution plate 16 into chamber 17. The gas then passes through foraminous cylinder 15 and foam covering 30 into contact with the filaments (FIGS. 1 and 2) in a profile of amounts that differ as shown in FIG. 3 wherein the length of arrows 21, 22, 23 and 24 correspond to velocities at the differing zones, according to the invention.

Thus, the extruded filaments pass through an air flow (quench) apparatus that is somewhat similar to that in Broaddus et al U.S. Pat. No. 4,712,988, but should be profiled to provide a low (but sufficient) air flow in the first zone (e.g., for a distance of about 1.4 inches) of the spinning way after the spinneret, followed by a higher flow in the next zone (e.g., for a distance of about 1.1 inches) of the spinning way as fiber acceleration occurs.

FIG. 2 shows one apparatus that provides such an air flow profile by providing an air delivery device with a low hole density per unit area in zone 1 (21) near the spinneret (11) and by increasing the hole diameter and/or density of the subsequent zone (22). Alternatively, the hole diameter of the first zone can be decreased or the supply chamber can be modified to limit the air flow, to achieve a similar result. Zone 2 (22) is then followed, respectively by Zones 3 (23) and 4 (24), with fewer holes per unit area, as the distance from the spinneret increases. Thus, the profile of distribution of supplied air is increased as the filaments accelerate immediately below the spinneret, and this has been found important for optimum spinability and filament uniformity, when spinning large numbers of fine filaments for subdenier staple.

Figure 3:
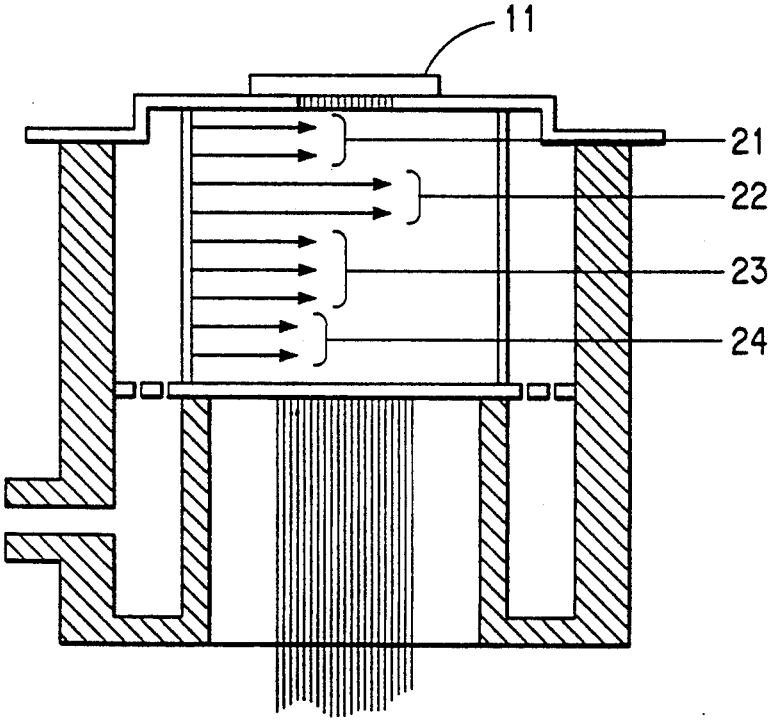
FIG. 3 is a schematic elevation view of a quench chamber showing a preferred air flow profile.

FIG. 3 shows air flow profile along the spinway attained with apparatus as shown in FIG. 2. Low air flow is provided in zone 1 (21) immediately under the spinneret to provide some cooling. An important difference from the art is that delayed quench is not desirable, as will be seen from the results in Example 1. On the other hand, we have found that too high an air flow at this location would not only lead to turbulent associated instabilities but would also increase threadline tension, leading to spinning discontinuities. These effects can become very significant with low denier filament spinning. This is a difference from the teaching of Broaddus. In the area where the filaments accelerate, high air flows are required to meet the needs of the accelerating threadline, i.e., in zone 2 (22 shown also in FIG. 3). Then, less and less additional air may be required in zones 3 and 4, respectively shown as 23 and 24 in FIG. 2 and 3, as the filaments proceed down the quench chamber and their acceleration decreases until a steady speed of withdrawal is attained. It has proved helpful to match the filament acceleration profile and the air flow profile, to the extent shown in FIG. 3, for example, in the critical spin region using the process of the invention.

The apparatus of the invention may be used to prepare, for example, spun polyester filaments (before drawing) that are typically of dtex (or denier per filament) less than about 4, e.g., as low as about 1.25, generally up to about 3.8. Corresponding drawn filaments and staple fiber are subdenier, and preferably about 0.6 to about 0.9 dtex. Such fibers of low viscosity polymer 10 are especially preferred, because of their advantageous properties in fabrics and garments, but have been difficult to produce economically heretofore.

TEST PROCEDURES

Relative Viscosity (LRV)

The relative viscosity (LRV) is as defined in Broaddus U.S. Pat. No. 4,712,988.

Crimp Takeup

The crimped rope is extended under 125 milligrams per denier load, clamped and cut at one meter length. The cut sample is mounted vertically and its length measured. Crimp takeup is calculated from the following formula, and expressed as a percentage of the extended length $$\text{Crimp Takeup} = \frac{Le - Lr}{Le} \times 100$$

where Le is the extended length (100 centimeters) and Lr is the relaxed length (i.e., when released from the load).

Interfilament Diameter Uniformity

Cross-sectional photographs (or video images) are made of a filament bundle at 35×magnification. The diameter of each filament cross-section is measured in two directions. Ten filaments are measured for a total of twenty measurements. The average and the standard deviation of these measurements of the diameter are used to calculate the per cent CV. This is listed in the Table for Example 1 under the column "UNIF." (Uniformity).

Filament Strength—Bundle Method

A section of rope is tensioned to 125 milligrams/denier and bundles of known length (longer than ten inches) of about 175 denier are selected and removed from the rope. The denier of each bundle is determined by weighing. Each sample is clamped in an Instron at a ten inch length and the crosshead is extended at a rate of 6 inches/minute. The breaking strength and elongation are calculated from the load applied and the length at the break. Five determinations are made and averaged together for each sample. Unless otherwise noted, all fiber strength data in this document is obtained via the bundle method.

Strength - Single Filament Method

The denier of a rope sample having a known number of filaments is determined by tensioning the rope at 125 milligrams/denier and weighing a one meter length. The individual filament denier is calculated from the total denier and the number of filaments. This average denier is taken as the single filament denier. Single filaments of 13 inches length are selected and carefully removed from the rope sample. Each filament is clamped in an Instron at a ten inch length and extended at a crosshead rate of 6 inches/minute. The breaking strength is calculated using the average denier. The percent length extension at break is taken as the elongation. Ten determinations are made and averaged together for each sample.

The invention is further illustrated by the following Examples:

EXAMPLE 1

Several sets of filaments were spun under different conditions from standard polyethylene terephthalate polymer of 20.4 LRV (about 0.64 IV), using a conventional melt unit in which the molten polymer is fed by a gear pump to a spinning block fitted with a filter and spinneret pack. Variations in the spinning conditions (especially quenching) are summarized in a Table, below, together with the spin operability (i.e., whether the spinning continuity was satisfactory, or inoperable because of frequent break outs, e.g., from drips) and the spun denier and uniformity of the spun filaments. The polymer was spun at a temperature of 290 degrees centigrade through a spinneret containing 1952 capillaries, arranged in 14 circles, as in FIG. 1, between an outer circle (12) of 4–6 inch diameter and an inner circle (13) of 2–52 inch diameter, giving a spinning density of 26 capillaries per square cm, each capillary with 0.007 inch diameter and 0.009 inch depth in a spinning cell having a 5.5 inch diameter. Throughput per capillary (TP/CAP in the Table) was varied from 0.232 to 0.31 gm/capillary/minute for a total spinning cell throughput (TP/CELL) varying from 60 to 80 lbs/hour.

The quench equipment used incorporated various air flow delivery or distribution systems which are referred to in the Table as follows: "Constant" indicates that similar sized perforations were provided in the foraminous distribution cylinder, after delayed quench, as indicated, for items A, B and C. "Gradient" indicates progressively decreasing air flow as described by Broaddus by progressively decreasing porosity in the cylinder, for item D. "Profile" indicates that the hole sizes are profiled to provide a moderate air flow in the 1.4 inches immediately below the spinneret (zone 1), followed by the highest air flow in the next zone (2) located at 1.5 to 2.5 inches along the cooling zone, then followed by progressively decreasing flow in succeeding zones 3 and 4, located 2.5–4.6 inches, and 4.6 to 6.5 inches, respectively, below the spinneret, as shown in FIGS. 2 and 3.

The total amount of air supplied is indicated by the air pressure, given in inches of water.

Lubricant is applied to the filament bundle with a rotary roller after the filament bundle (end) leaves the cooling zone. Spinning ends are combined and collected at withdrawal speeds that varied from 1600 to 1900 yards/min. Results are shown in the Table below.

It will be noted that the first items (A-E) all used polymer of 20.4 LRV. Of these, items A-D were comparisons, and only item E was according to the invention. Neither the constant nor the gradient system (items A-D) gave adequate operability or fiber uniformity for an acceptable process or product. On the other hand a profile system according to the process of the invention gave satisfactory operability and improved filament diameter uniformity (item E), using polymer of 20.4 LRV.

When, however, a similar profile air system was applied to low viscosity polyester (items F-L), satisfactory products and process were only obtained in items I, J, and K, when higher throughputs/capillary of 0.31 gm/min were used. Fibers spun under these conditions could only be drawn and heat set to a final denier per filament of 0.8, whereas lower deniers would also be desirable. Items L–N further show that it is necessary to match the total air supply to the acceleration of the filaments, even while using the profiled flow, to obtain satisfactory spinning performance and fiber uniformity with the difficult-to-spin 10 LRV polyester, especially to obtain low spun deniers, as indicated for these items. Items 0–U confirm that ranges of throughputs and spinning speeds that are acceptable with such matched air profiles increased when the profiled air flow system is used and the total air flow (supply pressure) is matched with the needs of the total filament bundle, e.g., to avoid back drafts. These are increasingly critical as the denier is reduced and the spinning density is increased.

It will be understood that, in addition to such fine denier polyester staple fiber, the apparatus of the invention may be used to produce melt spun filaments from other polymers, such as polyamides, for example, and polypropylene.

TABLE

| ITEM | LRV | QUENCH DELAY | HOLE SIZE | AIR SUPPLY IN WATER | TP/CAP G/Min | SPEED YPM | SPUN DENIER | UNIF. % CV | SPIN OPERABILITY |
|---|---|---|---|---|---|---|---|---|---|
| A | 20.4 | 2.4 | CONSTANT | 1.8 | 0.248 | 1900 | 1.36 | 61.0 | INOPERABLE |
| B | 20.4 | 1.4 | CONSTANT | 1.8 | 0.248 | 1900 | 1.36 | 40.8 | INOPERABLE |
| C | 20.4 | 0 | CONSTANT | 1.8 | 0.248 | 1900 | 1.32 | 30.0 | INOPERABLE |
| D | 20.4 | 1 | GRADIENT | 1.2 | 0.248 | 1900 | 1.31 | 47.5 | INOPERABLE |
| E | 20.4 | 0 | PROFILE | 1.2 | 0.248 | 1900 | 1.33 | 9.7 | SATISFACTORY |
| F | 10.0 | 0 | PROFILE | 1.2 | 0.271 | 1600 | 1.67 | — | DRIPS |
| G | 10.0 | 0 | PROFILE | 1.2 | 0.271 | 1700 | 1.57 | — | DRIPS |
| H | 10.0 | 0 | PROFILE | 1.2 | 0.271 | 1800 | 1.48 | — | INOPERABLE |
| I | 10.0 | 0 | PROFILE | 1.2 | 0.310 | 1600 | 1.91 | — | OPERABLE |
| J | 10.0 | 0 | PROFILE | 1.2 | 0.310 | 1700 | 1.8 | — | OPERABLE |
| K | 10.0 | 0 | PROFILE | 1.2 | 0.310 | 1800 | 1.7 | — | OPERABLE |
| L | 10.0 | 0 | PROFILE | 1.2 | 0.232 | 1800 | 1.27 | — | INOPERABLE |
| M | 10.0 | 0 | PROFILE | 0.8 | 0.232 | 1800 | 1.27 | — | SATISFACTORY |
| N | 10.0 | 0 | PROFILE | 0.5 | 0.232 | 1800 | 1.27 | — | UNSTABLE |
| O | 10.0 | 0 | PROFILE | 0.8 | 0.310 | 1800 | 1.72 | 5.5 | SATISFACTORY |
| P | 10.0 | 0 | PROFILE | 0.8 | 0.310 | 1700 | 1.84 | 4.7 | SATISFACTORY |
| Q | 10.0 | 0 | PROFILE | 0.8 | 0.310 | 1600 | 1.98 | 3.9 | SATISFACTORY |
| R | 10.0 | 0 | PROFILE | 0.8 | 0.271 | 1800 | 1.57 | 6.7 | SATISFACTORY |
| S | 10.0 | 0 | PROFILE | 0.8 | 0.271 | 1700 | 1.59 | 4.2 | SATISFACTORY |
| T | 10.0 | 0 | PROFILE | 0.8 | 0.271 | 1600 | 1.72 | 5 | SATISFACTORY |

TABLE-continued

| ITEM | LRV | QUENCH DELAY | HOLE SIZE | AIR SUPPLY IN WATER | TP/CAP G/Min | SPEED YPM | SPUN DENIER | UNIF. % CV | SPIN OPERABILITY |
|---|---|---|---|---|---|---|---|---|---|
| U | 10.0 | 0 | PROFILE | 0.8 | 0.232 | 1800 | 1.49 | 4.6 | SATISFACTORY |

What we claim is:

1. In an apparatus for melt spinning polymer that includes a spinneret, means for passing molten polymer through the spinneret, a hollow cylindrical foraminous member positioned immediately below the spinneret, and a plenum chamber supplied with a current of gas surrounding the foraminous member to form a quench chamber for the filaments to pass through to its exit, the improvement for changing the gas distribution pattern inwardly toward the filaments in the chamber to a profile defined by a low but significant gas flow in a first zone immediately below the spinneret, increasing through a larger gas flow in a second zone at a location below the first zone, and then decreasing to a lesser gas flow before the exit of the quench chamber, comprising forming said hollow foraminous member of porosity that increases from a first low porosity in said first zone immediately below the spinneret, through a larger porosity in said second zone at a lower location below said first zone, and then decreases to a second low porosity at the exit of the quench chamber.

2. The apparatus as defined in claim 1, wherein the foraminous member is formed from a perforated plate with holes of diameters that increase from corresponding first low values through larger values at said lower location to second low values at the exit.

3. The apparatus as defined in claim 1, wherein the foraminous member is formed from a perforated plate with a hole density that increases from a corresponding first low value through a larger value at said lower location to a second low value at the exit.

* * * * *